US008303268B2

(12) United States Patent
Werson et al.

(10) Patent No.: US 8,303,268 B2
(45) Date of Patent: Nov. 6, 2012

(54) ROTARY PUMP WITH A FIXED SHAFT

(75) Inventors: Michael John Werson, Eastleigh (GB); Colin Richard French, Winchester (GB)

(73) Assignee: Bühler Motor GmbH, Nürnberg (DE)

( * ) Notice: Subject to any disclaimer, the term of this patent is extended or adjusted under 35 U.S.C. 154(b) by 267 days.

(21) Appl. No.: 12/654,239

(22) Filed: Dec. 15, 2009

(65) Prior Publication Data

US 2010/0158725 A1 Jun. 24, 2010

(30) Foreign Application Priority Data

Dec. 19, 2008 (DE) ..... 10 2008 064 099

(51) Int. Cl.

| | |
|---|---|
| ***F02B 39/02*** | (2006.01) |
| ***F02B 39/06*** | (2006.01) |
| ***F02B 17/00*** | (2006.01) |
| ***H02K 21/12*** | (2006.01) |

(52) U.S. Cl. ..... 417/366; 417/423.7; 417/420; 417/423.8; 310/90; 310/268; 310/156.32; 310/87; 310/86

(58) Field of Classification Search ..... 417/423.7, 417/423.14, 366, 420, 423.8, 424.2; 310/60 A, 310/63, 268, 156.32–156.37, 90, 86, 87, 310/88; *H02K 21/24*

See application file for complete search history.

(56) References Cited

U.S. PATENT DOCUMENTS

| | | | | | |
|---|---|---|---|---|---|
| 2,782,721 | A | * | 2/1957 | White | 417/357 |
| 3,304,450 | A | * | 2/1967 | Bosco, Jr. et al. | 310/126 |
| 3,364,866 | A | * | 1/1968 | Sato | 417/365 |
| 3,767,330 | A | * | 10/1973 | Signorile | 417/420 |
| 3,932,069 | A | * | 1/1976 | Giardini et al. | 417/420 |
| 4,013,384 | A | * | 3/1977 | Oikawa | 417/368 |
| 4,047,847 | A | * | 9/1977 | Oikawa | 417/370 |
| 4,806,080 | A | * | 2/1989 | Mizobuchi et al. | 417/353 |
| 5,184,937 | A | | 2/1993 | Arakawa et al. | |
| 5,269,664 | A | * | 12/1993 | Buse | 417/360 |
| 5,803,720 | A | * | 9/1998 | Ohara et al. | 417/420 |
| 5,997,261 | A | * | 12/1999 | Kershaw et al. | 417/366 |

(Continued)

FOREIGN PATENT DOCUMENTS

DE 3831457 A1 3/1990

(Continued)

OTHER PUBLICATIONS

Machine Translation of DE19646617.*

(Continued)

*Primary Examiner* — Devon Kramer
*Assistant Examiner* — Thomas Fink
(74) *Attorney, Agent, or Firm* — Jacobson Holman PLLC

(57) ABSTRACT

A rotary pump (1) with a multipart pump housing (4), comprising a suction connector (6) and a pressure connector (7), a pump impeller (5) mounted on a fixed shaft (3), the pump rotor (5) being designed as a permanent magnetic rotor cooperating with an electromagnetic stator. The task of the invention in a rotary pump is to achieve excellent efficiency in a compact design. The rotary pump is also supposed to guarantee high lifetime and improved heat removal. This task is solved according to the invention in that the shaft (3) is firmly connected to a first pump housing (2), referred to as pump head, which includes the suction connector (6) or is connected to it, the shaft (3) forming an axis of symmetry to an inside wall area of pump head (2).

15 Claims, 5 Drawing Sheets

U.S. PATENT DOCUMENTS

| | | | | |
|---|---|---|---|---|
| 6,034,465 | A * | 3/2000 | McKee et al. | 310/268 |
| 6,132,186 | A * | 10/2000 | Cooper et al. | 417/423.7 |
| 6,139,289 | A * | 10/2000 | Obata et al. | 417/420 |
| 6,152,704 | A * | 11/2000 | Aboul-Hosn et al. | 417/360 |
| 6,309,188 | B1 * | 10/2001 | Danner | 417/366 |
| 6,776,590 | B2 * | 8/2004 | Cooper et al. | 417/423.7 |
| 6,835,051 | B2 * | 12/2004 | Heim et al. | 417/423.7 |
| 7,618,338 | B2 | 11/2009 | Greenwood | |
| 7,753,645 | B2 * | 7/2010 | Wampler et al. | 415/104 |
| 2002/0081221 | A1 * | 6/2002 | Cooper et al. | 417/420 |
| 2002/0150486 | A1 * | 10/2002 | Cooper et al. | 417/423.7 |
| 2007/0090704 | A1 * | 4/2007 | Chen | 310/86 |
| 2008/0089797 | A1 * | 4/2008 | Wampler et al. | 417/420 |
| 2008/0226474 | A1 * | 9/2008 | Yoshida et al. | 417/366 |
| 2009/0081059 | A1 * | 3/2009 | Seki et al. | 417/420 |
| 2009/0252607 | A1 | 10/2009 | Hein et al. | |

FOREIGN PATENT DOCUMENTS

| | | | |
|---|---|---|---|
| DE | 19646617 | A1 * | 5/1998 |
| EP | 0406868 | B1 | 5/1996 |
| EP | 1329638 | A1 | 7/2003 |
| EP | 2047106 | A1 | 4/2009 |
| JP | 2002257074 | A | 9/2002 |
| WO | WO 2007014807 | A1 | 2/2007 |

OTHER PUBLICATIONS

Machine translation of JP-2002-257074, published Sep. 2002.*

* cited by examiner

ROTARY PUMP WITH A FIXED SHAFT

BACKGROUND OF THE INVENTION (1) Field of the Invention

The invention concerns a rotary pump with a multipart pump housing, comprising a suction connector and a pressure connector, and a pump impeller mounted on a fixed shaft, the pump impeller being designed as a permanent magnetic rotor that cooperates with an electromagnetic stator.

(2) Description of Related Art Including Information Disclosed Under 37 CFR 1.97 and 1.98

A generic rotary pump is known from DE 196 46 617 A1, in which a shaft is accommodated in the pump, but it is inserted, so that slight inaccuracies must be tolerated in coordination between the shaft and the pump housing.

An object of the present invention is to achieve excellent efficiency in a compact design in a rotary pump of the generic type just mentioned. The rotary pump is also supposed to guarantee long lifetime and improved heat removal.

BRIEF SUMMARY OF THE INVENTION

The object is met according to the invention which relates to a rotary pump driven by an electric motor with a stator. The rotary pump consists of a multipart pump housing having a first pump housing part defining a pump head with an inside wall area; a pressure connector connected to the first housing part; a suction connector connected to the pump head; a fixed shaft connected to the stator, the fixed shaft forming an axis of symmetry to the inside wall area of the pump head; and a permanent magnetic pump impeller rotatably mounted on the fixed shaft.

A situation is achieved, in which exact coordination between the shaft and an inside wall area of the pump head is achieved, so that the intermediate annular leakage space is reduced and the pump efficiency is significantly improved. This has an effect, especially in rotary pumps with high feed pressure, but low feed volume.

More reliable fastening of the shaft is obtained by the fact that it is enclosed by housing material of the pump head in shape-mated fashion. In a partially hollow shaft, a coolant stream can be guided through it and contribute to better heat removal of the pump. In order to achieve low wear of the shaft, it is expedient to make it from ceramic material.

A second bearing site, formed by an axial bearing ring, in which the shaft is regularly supported, ensures low-vibration running. The axial bearing ring serves for axial bearing of the pump impeller on the shaft. The axial bearing ring is accommodated in a partially tubular heat-conducting element. This extends into the pump space. A bearing-mounting ring is provided between the heat-conducting element and the axial bearing ring.

The shaft, according to a preferred further modification of the invention, extends freely into a cavity with a significant part of its length, the cavity being bounded by the heat-conducting element. This cavity is traversed by the feed medium, in order to cool the pump. The percentage of the shaft extending freely into the cavity is preferably between 30-50% of the total length of the shaft.

The inventive method for production of a precise alignment of the shaft to an inside wall area of the pump head consists of the steps: Insertion of the shaft into an injection molding die for pump head, deformation of the pump head with precise alignment of the shaft to an inside wall area of pump head. In an alternative variant, the shaft is press-fit into the pump head.

BRIEF DESCRIPTION OF THE SEVERAL VIEWS OF THE DRAWINGS

A practical example of the invention is further explained below with reference to the drawing. In the drawing.

DETAILED DESCRIPTION OF THE INVENTION

Figure 1:
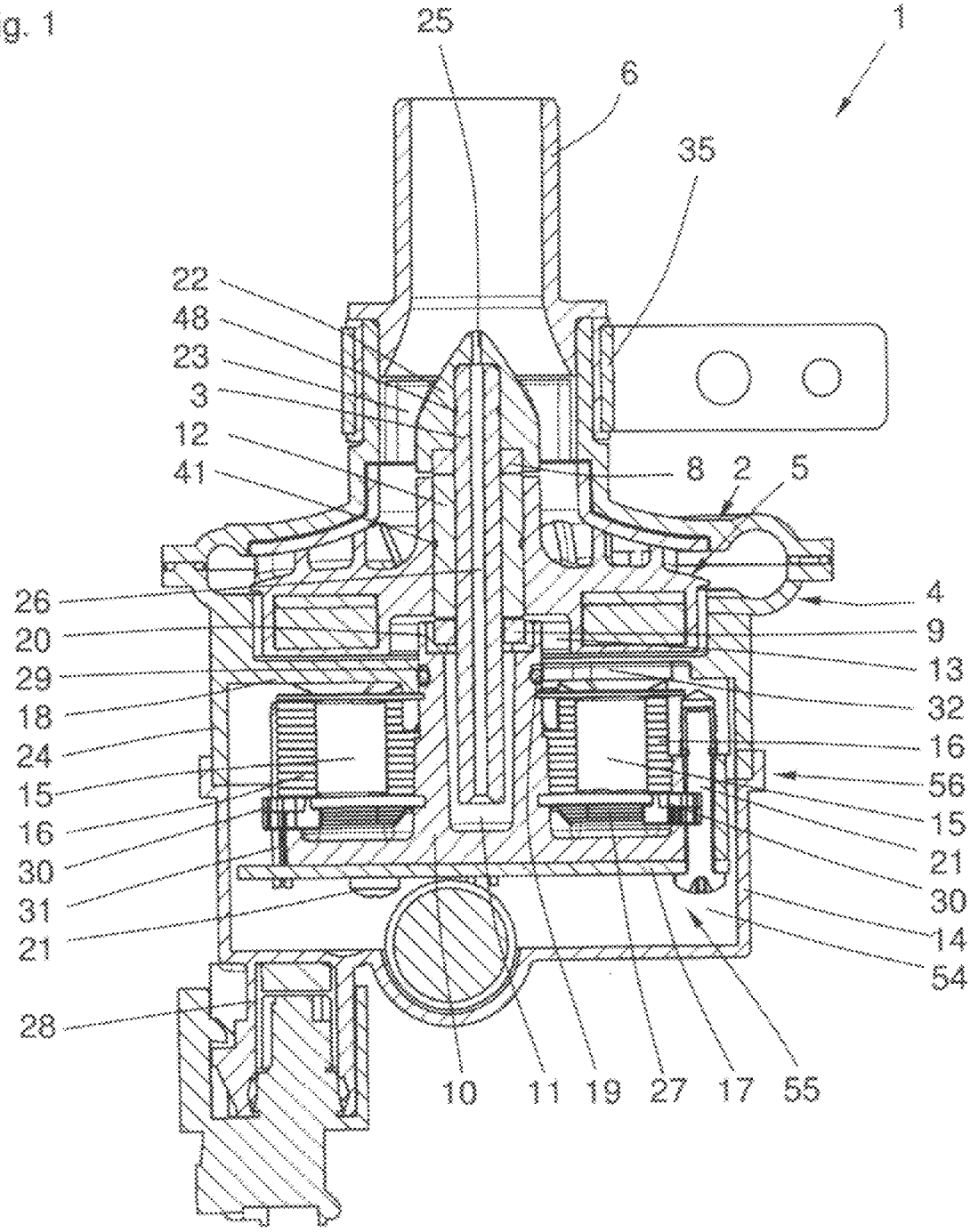
FIG. 1 shows a sectional view through a rotary pump.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

FIG. 1 shows a sectional view through a rotary pump 1 operated by an axial motor 56, with a pump housing 4, consisting of a first pump housing part 2 (pump head), a second pump housing part 24, with a split plate 18 and a motor housing 14 bounding a dry chamber 54, a pump impeller 5, mounted to rotate on a shaft 3 via a fixed bearing 12, said fixed bearing 12 being supported axially, on the one hand, on a first axial bearing ring 8 and, on the other hand, on a second axial bearing ring 9, a heat-conducting element 10, consisting of aluminum and forming a component of stator 55, stator poles 15, stator windings 16, a circuit board 17, which is fastened to the second pump housing part 24 with stator mounting screws 21 via the heat-conducting element 10. A suction connector 6 is arranged on the first pump housing part 2 (pump head), which is coaxial to shaft 3. Shaft 3 is fastened in a mounting pin 22, which is in one piece with suction connector 6 via spokes 23. The end of the mounting pin 22 tapers in order to offer only slight resistance to the inflowing pump medium. The center of the mounting pin 22 forms a passage 25 to a flow channel 26 in the center of hollow shaft 3. The heat-conducting element consists of a stator support disk 40, in whose central area a stator support tube 39, and on whose periphery three spacers 38 protrude. The connection area of the heat-conducting area 10 to split plate 18 is sealed by an annular seal 19, inserted into a peripheral groove 29 in the stator support tube 39. Stator mounting screws 21 serve for fastening of a circuit board 17 and fastening of the heat-conducting element 10 on the second pump housing part 24.

Figure 2:
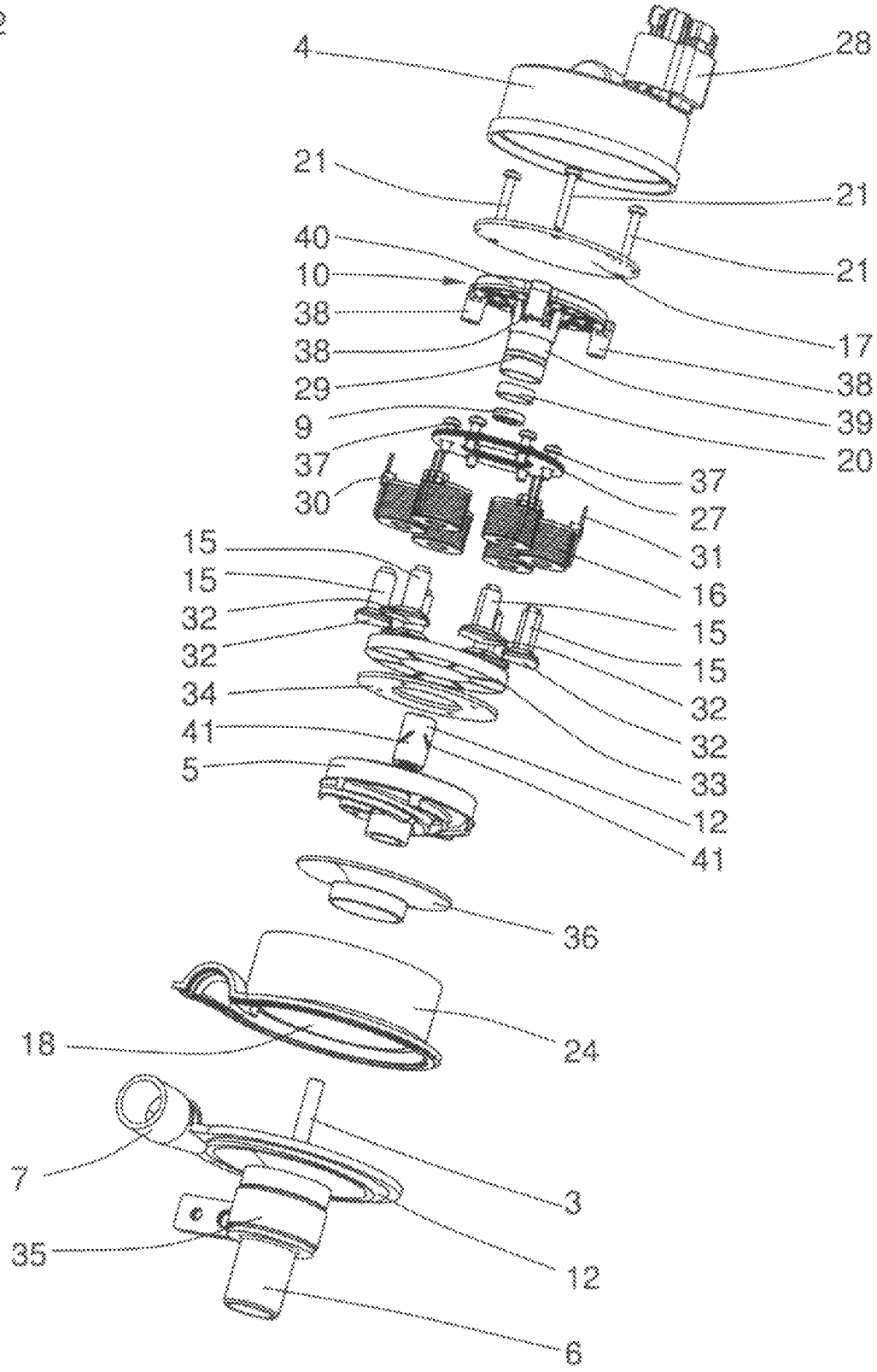
FIG. 2 shows an exploded view of the rotary pump.

FIG. 2 shows from the top down the motor housing 4 with the molded-on plug housing 28, the stator mounting screws 21, the circuit board 17, the heat-conducting element 10 with the stator support disk 40, the spacers 38, the stator support tube 39 and the groove 29, the bearing support ring 20, the axial support ring 9, a stator return ring 27, which are fastened to the return mounting screws 37, insulation elements 30, with connection pins 31, in which the insulation elements 30 are wound with stator winding 16, the stator poles 15 with pole shoes 32, larger in cross-section, a rotor magnet 33, a rotor return ring 34, fixed bearing 12, with notches 41 for internal connection to the pump impeller 5, a cover disk 36, the second pump housing part 24 with the split plate 18, the shaft 3, the first pump housing 2 (pump head), a fastening ring 35, the support connector 6 and a pressure connector 7. In the interest of clarity, the sequence of components is partially transposed in FIG. 2.

The pump motor from FIGS. 1 and 2 is an electrically commutated DC motor with individual poles aligned parallel to the axis of rotation, each with a cylinder coil. The motor has an axial air gap. The return ring 27 of the stator consists of a laminated core. The stator poles 15 are made from powdered metal. Return ring 27 and poles 15 are screwed to each other and to the stator element. Through another screw connection the circuit board 17 is screwed to the heat-conducting element 10 and the second pump housing part 24. The pump rotor 5 forms the permanent magnetic rotor of the DC motor with the rotor magnet 33, the rotor return ring 34 and the hollow cylindrical fixed bearing 12. The rotor magnet 33, as well as the rotor return ring 34.

Figure 3:
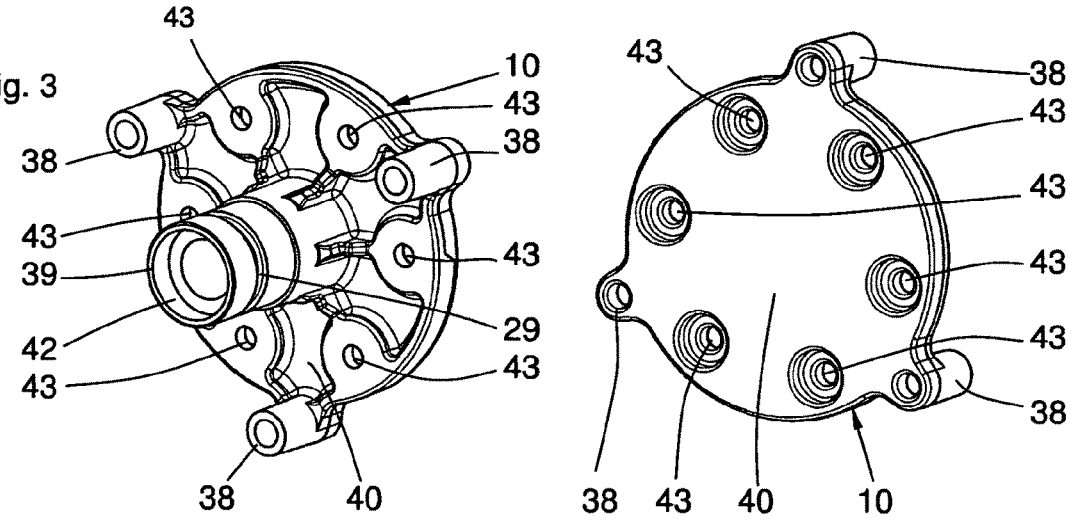
FIG. 3 shows three-dimensional views of a heat-conducting element.

FIG. 3 shows three-dimensional views of the heat-conducting element 10 with the stator support disk 40, the stator support tube 39, the spacers 38, groove 29, a receiving space 42 for the bearing support ring 20 and pole fastening recesses 43.

Figure 4:
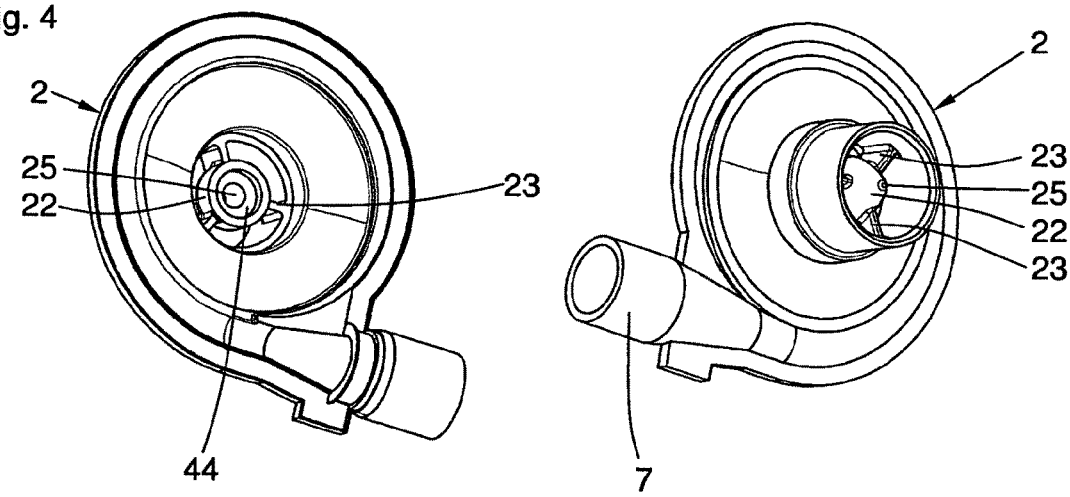
FIG. 4 shows three-dimensional views of a first pump housing part.

FIG. 4 shows three-dimensional views of the first pump housing part 2 with the mounting pin 22, spokes 23, passage 25 and a receiving space for the first axial bearing ring 44.

Figure 5:
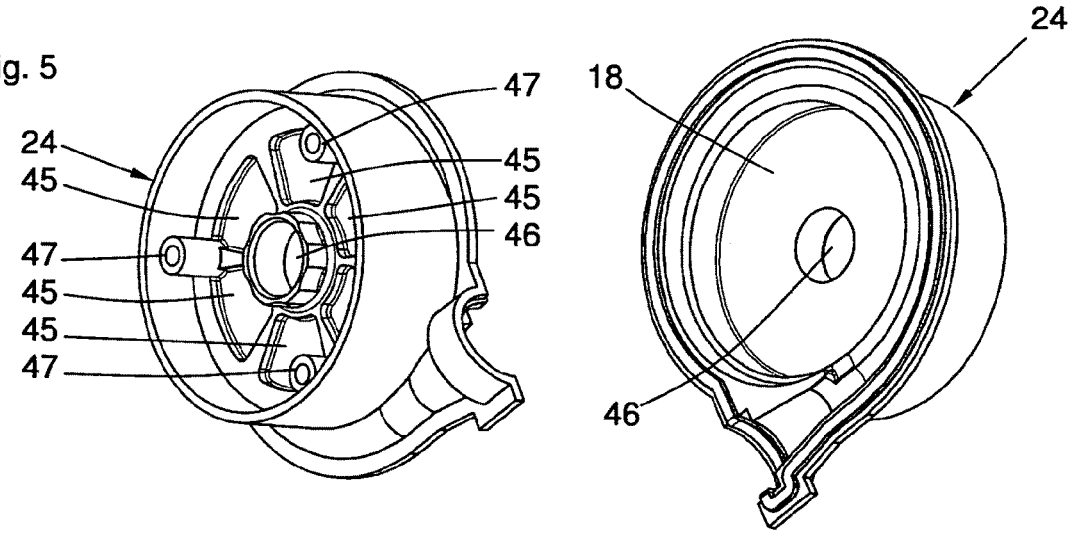
FIG. 5 shows three-dimensional views of a second pump housing part.

FIG. 5 shows three-dimensional views of the second pump housing part 24 with the split plate 18, which has recesses 45 in the area of the poles being installed, in order to obtain the smallest possible air gap in the magnet circuit of the motor, a central passage 46 for shaft 3 and three threaded bushings 47 for fastening of the stator by means of the stator mounting screws.

Figure 6:
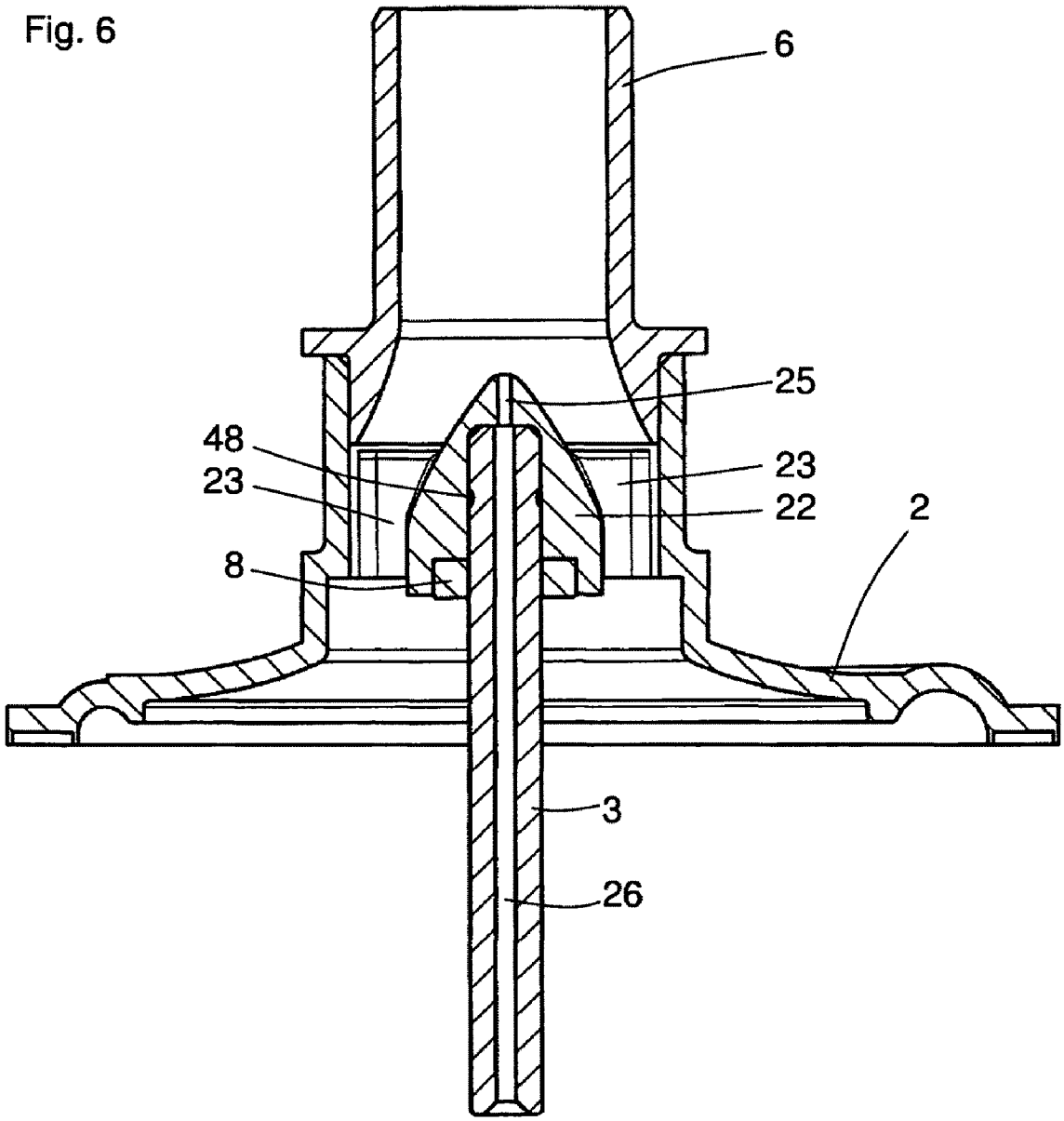
FIG. 6 shows a sectional view through the first pump housing part with an installed fixed shaft.

FIG. 6 shows a sectional view through the first pump housing part 2 with the installed fixed shaft 3, with its flow channel 26, passage 25, the first axial bearing ring 8, the spokes 23 and the suction connector 6. The shaft has a notch 48 that ensures internal connection to the mounting pin.

Figure 7:
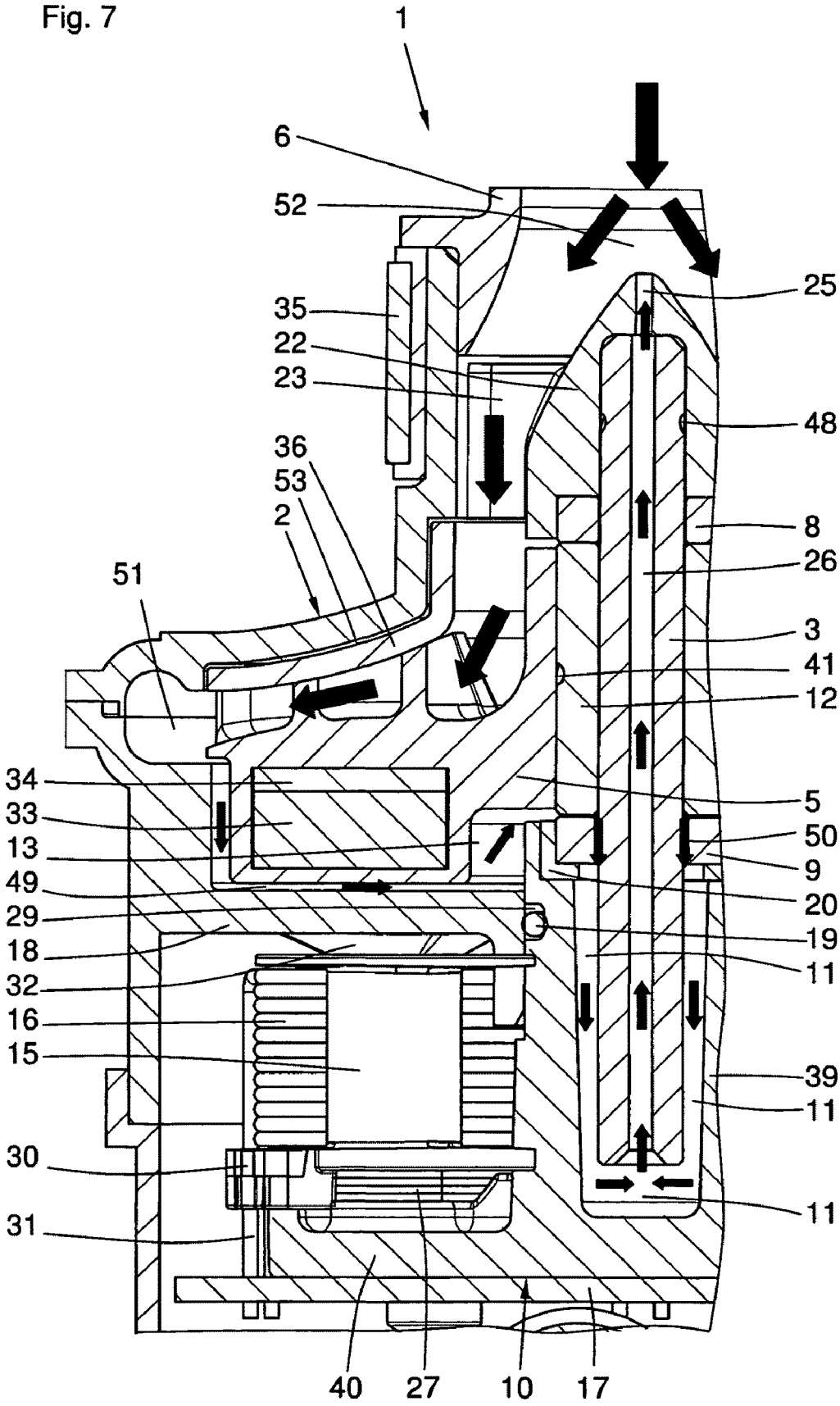
FIG. 7 shows an enlarged partial sectional view of the pump.

FIG. 7 shows an enlarged partial sectional view of the rotary pump 1 according to the invention that permits a continuous cooling and degassing stream to run from a pressure area 51 via "air gap" 49 and an annular gap 50 between the second axial bearing ring 9 and the shaft 3 into cavity 11 and from there, via flow channel 26 of the hollow shaft 3 and the passage 25 of the mounting pin 22, back into the suction area 52. The special feature here is the large surface, over which the heat-conducting element 10, which consists of a good heat-conducting aluminum, is in contact with the feed medium. The size of this surface is determined by the length of the cavity 11, its diameter, the length of the stator support tube 39 that extends into pump space 13 and its diameter. Through the described configuration, the feed medium is forced into a type of meandering trend and can absorb heat from the heat-conducting element 10 and remove it longer than in previously known solutions. Despite this large heat transfer surface, the size, relative to comparable pumps, is not increased and only a small annular sealing area is present, which can be sealed with simple means, as in this case with the annular seal 19 inserted into groove 29. A gap 53 between the cover disk 36 of pump impeller 5 and the first pump housing part 2 is more readily apparent in FIG. 7 than in FIG. 1. This gap 53 must be as small as possible, in order to achieve high efficiency. Through the exactly aligned shaft 3 during the deformation process of the first pump housing part 2, maximum accuracy is achieved.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically disclosed.

LIST OF REFERENCE NUMBERS

1 Rotary pump
2 Pump housing part (pump head)
3 Shaft
4 Pump housing
5 Pump impeller
6 Suction connector
7 Pressure connector
8 First axial bearing ring
9 Second axial bearing ring
10 Heat-conducting element
11 Cavity
12 Hollow cylindrical fixed bearing
13 Pump space
14 Motor housing
15 Stator pole
16 Stator winding
17 Circuit board
18 Split plate
19 Annular seal
20 Bearing mounting ring
21 Stator mounting screws
22 Mounting pin
23 Spokes
24 Second pump housing part
25 Passage in mounting pin
26 Flow channel
27 Stator return ring
28 Plug housing
29 Groove
30 Insulation element
31 Connection pin
32 Pole shoe
33 Rotor magnet
34 Rotor return ring
35 Fastening ring
36 Cover disk (to pump impeller 5)
37 Return mounting screws
38 Spacers
39 Stator support tube
40 Stator support disk
41 Notch
42 Receiving space
43 Pole fastening recesses
44 Mounting space for axial bearing ring
45 Recesses for poles
46 Passage for shaft
47 Threaded bushing
48 Notch in shaft
49 Air gap
50 Annular gap
51 Pressure area
52 Suction area
53 Gap

54 Dry chamber
55 Stator
56 Axial motor

What is claimed is:

1. A rotary pump driven by an electric motor with a stator, the rotary pump comprising:

a multipart pump having a motor housing and a pump housing including a first pump housing part defining a pump head with an inside wall area inside of the pump housing;

a pressure connector connected to the first housing part;

a suction connector connected to the pump head;

an elongated fixed shaft defining an axial direction and having a first end and a second end, the first end being in the pump housing and the second end being in the motor housing;

mounting means for exclusively and fixedly supporting the elongated fixed shaft in the pump housing at the first end and allowing the second end to extend freely unsupported, the second end extending into the motor housing with no point of attachment to the motor housing;

an electric motor including:

a permanent magnet pump impeller located in the pump housing; and a stator located in the motor housing, the stator causing the permanent magnet pump impeller to rotate about the fixed shaft; and a bearing for providing exclusive rotatable mounting of the impeller only in the pump housing to the first end of the fixed shaft, the bearing including a radial bearing and axial bearings, both the mounting means for fixedly mounting and the bearing being located outside the extent of the stator in the axial direction, and the fixed shaft extending within the extent of the stator in the axial direction.

2. The rotary pump according to claim 1, wherein the mounting means comprises a mounting pin in the pump head wherein the fixed shaft is connected in shape-mated fashion to the mounting pin secured to the first pump housing part.

3. The rotary pump according to claim 1, wherein the fixed shaft is partially hollow.

4. The rotary pump according to claim 1, wherein the fixed shaft is hollow over its entire length.

5. The rotary pump according to claim 1, wherein the fixed shaft consists of a ceramic material.

6. The rotary pump according to claim 1, wherein the axial bearings comprise a first axial bearing ring arranged on the fixed shaft for axial bearing of the pump impeller.

7. The rotary pump according to claim 1, wherein the axial bearings comprise a first axial bearing ring arranged in the pump head for axial bearing of the pump impeller.

8. The rotary pump according to claim 6, wherein the axial bearings comprise a second axial bearing ring accommodated in a heat-conducting element in the first pump housing part.

9. The rotary pump according claim 8, wherein a bearing support ring is arranged between the second axial bearing ring and the heat-conducting element.

10. The rotary pump according to claim 8, wherein the pump impeller is arranged and mounted to freely rotate between the first and second axial bearing rings.

11. The rotary pump according to claim 9, wherein the radial bearing of the pump impeller has a hollow cylindrical fixed bearing having sliding surfaces on both ends, the sliding surfaces being supported on the first and second axial bearing rings.

12. The rotary pump according to claim 1, wherein the heat-conducting element protrudes into the pump housing.

13. The rotary pump according to claim 1, wherein a part of the fixed shaft extends freely into a cavity bounded by a heat-conducting element within the motor housing.

14. The rotary pump according to claim 13, wherein the second end of the elongated fixed shaft extending freely into the cavity occupies 20-60% of the total length of the elongated fixed shaft.

15. The rotary pump according to claim 1, further comprising:

wherein the axial bearings comprise a first axial bearing ring arranged on the elongated fixed shaft for axial bearing of the pump impeller, and a second axial bearing ring arranged on the elongated fixed shaft for axial bearing of the pump impeller; a second pump housing part forming part of the multipart pump housing; a split plate adjacent the second pump housing part; an air gap formed between the pump impeller and the split plate; a cavity defined in the pump housing for receiving a portion of the elongated fixed shaft; a flow channel defined in the elongated fixed shaft; and a mounting pin receiving a portion of the elongated fixed shaft, the mounting pin having a passage in communication with the flow channel, wherein part of a feed medium can be guided back into a main hydraulic circuit via a closed path from a pressure area of the pump via the air gap, an intermediate space between the second axial bearing ring and the fixed shaft, the cavity, the flow channel and the passage.

* * * * *